US006685892B1

(12) United States Patent
Vora et al.

(10) Patent No.: US 6,685,892 B1
(45) Date of Patent: Feb. 3, 2004

(54) PROCESS AND APPARATUS FOR CONTROLLING REACTION TEMPERATURES

(75) Inventors: Bipin V. Vora, Naperville, IL (US); Raymond A. Pogliano, Carpentersville, IL (US)

(73) Assignee: UOP LLC, Des Plaines, IL (US)

( * ) Notice: Subject to any disclaimer, the term of this patent is extended or adjusted under 35 U.S.C. 154(b) by 244 days.

(21) Appl. No.: 09/815,188

(22) Filed: Mar. 22, 2001

Related U.S. Application Data

(62) Division of application No. 09/541,760, filed on Apr. 3, 2000, now Pat. No. 6,280,609, which is a continuation of application No. 09/058,606, filed on Apr. 10, 1998, now abandoned.

(51) Int. Cl.[7] ..... B01J 8/00; C10G 35/04; C10G 35/10

(52) U.S. Cl. ..... 422/198; 422/190; 422/197; 422/200; 422/213; 422/216; 422/218

(58) Field of Search ..... 422/213, 218, 422/216, 196, 214, 197, 223, 190, 220, 198, 200

(56) References Cited

U.S. PATENT DOCUMENTS

| | | | | |
|---|---|---|---|---|
| 2,550,727 A | | 5/1951 | Shimp | 208/165 |
| 3,652,231 A | | 3/1972 | Greenwood et al. | 422/223 |
| 4,112,058 A | | 9/1978 | Hanson | 423/415 A |
| 4,849,092 A | | 7/1989 | Ham et al. | 208/140 |
| 5,047,217 A | | 9/1991 | Dang Vu et al. | 422/200 |
| 5,073,352 A | | 12/1991 | Dang Vu et al. | 422/213 |
| 5,167,933 A | * | 12/1992 | Norsk | 422/148 |
| 5,190,638 A | | 3/1993 | Swan, III et al. | 208/65 |
| 5,190,639 A | | 3/1993 | Swart et al. | 208/65 |
| 5,196,110 A | | 3/1993 | Swart et al. | 208/65 |
| 5,417,843 A | | 5/1995 | Swart et al. | 208/65 |
| 5,525,311 A | | 6/1996 | Girod et al. | 422/200 |
| 6,432,369 B1 | * | 8/2002 | Mulvaney et al. | 422/213 |

* cited by examiner

*Primary Examiner*—Hien Tran
(74) *Attorney, Agent, or Firm*—John G. Tolomei; James C. Paschall

(57) ABSTRACT

A process and apparatus for contacting reactants with a particulate catalyst while indirectly contacting the reactants with a heat exchange medium performs heat exchange in a first reaction zone and moves catalyst, at least intermittently, through the second reaction zone while the process is operating. The first reaction zone is preferably a fixed bed reaction zone. The use of first reaction zone as a fixed bed reaction zone simplifies the process arrangement by not requiring means for catalyst movement in a reaction zone that performs simultaneous heat exchange. Long periods of operation are possible since the first reaction zone will typically experience a slow rate of catalyst deactivation and need infrequent regeneration. The first reaction zone may also be designed for catalyst movement, but independently controlled from the first reaction zone to facilitate the movement of catalyst therethrough.

6 Claims, 2 Drawing Sheets

PROCESS AND APPARATUS FOR CONTROLLING REACTION TEMPERATURES

CROSS-REFERENCE TO RELATED APPLICATIONS

This application is a Division of application Ser. No. 09/541,760 filed Apr. 3, 2000, now U.S. Pat. No. 6,280,609, which application is a Continuation of Application No. 09/058,606 filed Apr. 10, 1998, now abandoned, the contents of which are hereby incorporated by reference.

FIELD OF THE INVENTION

This invention relates to chemical reactors for the conversion of a reaction fluid while replacing catalyst and indirectly exchanging heat with a heat exchange fluid.

BACKGROUND OF THE INVENTION

In many industries, like the petrochemical and chemical industries for instance, the processes employ reactors in which chemical reactions are effected in the components of one or more reaction fluids under given temperature and pressure conditions. Most of these reactions generate or absorb heat to various extents and are, therefore, exothermic or endothermic. The heating or cooling effects associated with exothermic or endothermic reactions can positively or negatively affect the operation of the reaction zone. The negative effects can include, among other things, lower product production, deactivation of the catalyst, production of unwanted by-products and, in extreme cases, damage to the reaction vessel and associated piping. More typically, the undesired effects associated with temperature changes will reduce the selectivity or yield of products from the reaction zone.

One solution to the problem of negative temperature effects has been the indirect heating of reactants and/or catalysts within a reaction zone with a heating or cooling medium. The most well known catalytic reactors of this type are tubular arrangements that have fixed or moving catalyst beds. The geometry of tubular reactors poses layout constraints that require large reactors or limit throughput.

Indirect heat exchange has also been accomplished using thin plates to define alternate channels that retain catalyst and reactants in one set of channels and a heat transfer fluid in alternate channels for indirectly heating or cooling the reactants and catalysts. Heat exchange plates in these indirect heat exchange reactors can be flat or curved and may have surface variations such as corrugations to increase heat transfer between the heat transfer fluids and the reactants and catalysts. Although the thin heat transfer plates can, to some extent, compensate for the changes in temperature induced by the heat of reaction, not all indirect heat transfer arrangements are able to offer the complete temperature control that would benefit many processes by maintaining a desired temperature profile through a reaction zone. Many hydrocarbon conversion process will operate more advantageously by maintaining a temperature profile that differs from that created by the heat of reaction. In many reactions, the most beneficial temperature profile will be obtained by substantially isothermal conditions. In some cases, a temperature profile directionally opposite to the temperature changes associated with the heat of reaction will provide the most beneficial conditions. An example of such a case is in dehydrogenation reactions wherein the selectivity and conversion of the endothermic process are improved by having a rising temperature profile that reverses the normal adiabatic temperature gradient through the reaction zone. A specific arrangement for heat transfer and reactant channels that offers more complete control can be found in U.S. Pat. No. 5,525,311 B1, the contents of which are hereby incorporated by reference.

Most catalysts for the reaction of hydrocarbons are susceptible to deactivation over time. Deactivation will typically occur because of an accumulation of deposits that cause deactivation by blocking active pore sites or catalytic sites on the catalyst surface. Where the accumulation of coke deposits causes the deactivation, reconditioning the catalyst to remove coke deposits restores the activity of the catalyst. Coke is normally removed from the catalyst by contact of the coke-containing catalyst with an oxygen-containing gas at a high enough temperature to combust or remove the coke in a regeneration process. The regeneration process can be carried out in situ or the catalyst may be removed from a vessel in which the hydrocarbon conversion takes place and transported to a separate regeneration zone for coke removal. Arrangements for continuously or semi-continuously removing catalyst particles from a bed in a reaction zone for coke removal in a regeneration zone are well known. U.S. Pat. No. 3,652,231 B1 describes a continuous catalyst regeneration process which is used in conjunction with the catalytic reforming of hydrocarbons, the teachings of which are hereby incorporated by reference. In the reaction zone of U.S. Pat. No. 3,652,231 B1, the catalyst is transferred under gravity flow by removing catalyst from the bottom of the reaction zone and adding catalyst to the top while reactants flow cross-currently through a radial flow bed. U.S. Pat. No. 5,073,352 B1 describes a reforming reaction system adapted to move a compact bed of catalyst downward in reactant channels for on-stream catalyst replacement while a reactant stream flows cross-wise through the reactant channels and while heat exchange channels, interleaved with the reactant channels, provide indirect heat from a heating stream. It is also known from U.S. Pat. No. 2,550,727 B1 to move catalyst through a compact bed of catalyst particles by withdrawing particles from the compact bed of catalyst particles while passing reactants through the compact bed of catalyst in a direction co-current to the direction of catalyst movement.

A phenomenon known as "pinning" inhibits catalyst transfer in many reactor arrangements. Pinning is the phenomenon wherein the flow of fluid at sufficient velocity can block the downward movement of catalyst. Pinning is a function of the gas composition, the gas velocity, the physical characteristics of the catalyst and the physical characteristics of the flow channel through which the catalyst must move. As the gas flows through the channels that retain the catalyst, the gas impacts the catalyst particles and raises intergranular friction between the particles. When the vertical component of the frictional forces between the particles overcomes the force of gravity on the particles, the particles become pinned. As the flow path length of gas through the catalyst particles becomes longer, the forces on the particles progressively increase from the outlet to the inlet of the flow channel. In addition, as the catalyst flow channel becomes more confined, the gravity flow of catalyst particles becomes more hindered. Accordingly, as the size of the flow channel becomes more confined, wall effects increasingly add to the vertical hold-up force on the catalyst particles. As a result, narrow flow channels have a greater susceptibility to pinning and cannot normally provide continuous catalyst circulation.

In the case of reactors providing indirect heat exchange, the arrangement of the reactor exacerbates the problem of catalyst pinning. Increasing the number of channels by decreasing their size facilitates heat transfer by increasing the surface area between the heat exchange fluid and the catalyst. In addition, heat transfer is further facilitated by irregularities in the plate surface that create turbulence and reduce film factors that interfere with heat exchange. However, irregularities in the plates that define the channels further interfere with the movement of catalyst and promote a greater tendency for the catalyst to "pin". Therefore, methods and reactor arrangements are sought to use a channel-type reactor that facilitates heat exchange and catalyst circulation while the reactor continues operation.

It is known to avoid some of the complexities of on-stream catalyst circulation by using a combination of fixed bed and moving bed reactor systems in series to treat a reactant stream. Combinations of series flow reactant streams that pass reactants through a fixed bed upstream of a moving bed system, downstream of a moving bed system, or have parallel trains of moving bed and fixed bed systems are shown in U.S. Pat. No. 5,417,843 B1, U.S. Pat. No. 5,196,110 B1, U.S. Pat. No. 5,190,639 B1, U.S. Pat. No. 5,190,638 B1 and U.S. Pat. No. 4,849,092 B1. None of these references discusses the possibility of incorporating heat exchange into any of the reaction arrangements discussed therein.

Accordingly, it is an object of this invention to provide a process for the contact of reactants with a bed of catalyst while providing indirect heat exchange with a heat exchange fluid and on-stream circulation of the catalyst.

It is a further object of this invention to provide a simple reactor apparatus for indirect heat exchange of a reactant stream and for contact of the reactant stream with a bed of catalyst while obtaining advantages that attend on-stream circulation of the catalyst.

BRIEF SUMMARY OF THE INVENTION

This invention is a process and apparatus for serial flow of a reactant stream through one reaction zone that performs simultaneous indirect heat exchange between the reactant stream and a heat exchange fluid and through another reaction zone in which catalyst can be at least intermittently moved while the reactants contact the catalyst. The process simplifies an arrangement for indirectly exchanging heat with a heat transfer fluid during the reaction of reactants and for replacing catalysts during the operation of a process where catalyst becomes quickly deactivated. The process arrangement of this invention is most beneficially used where the reactants benefit from heat exchange in a reaction zone that at the same time has a relatively low rate of catalyst deactivation compared to the other reaction zone in the series. While the invention is most beneficially used with a fixed bed of catalyst in the reaction zone that provides heat exchange, process simplification is still possible by the use of this invention to provide only a series of reaction zones that all have on-stream catalyst replacement and only one reaction zone in the series also provides indirect heat exchange.

A number of endothermic reactions are advantageously carried out using the process and arrangement of this invention. In the dehydrogenation of light hydrocarbons, significant amounts of potential product are lost through thermal decomposition as reactants are heated to enter the first reactor. It has been found that up to 70% of the thermal cracking losses in a dehydrogenation reactor arrangement are attributable to thermal losses associated with the heat up and conversion of reactants in the first reaction of the series. It has also been found that the first reaction zone in the series will have an overall coking rate that is lower than the subsequent reactors in the series and relatively low overall. In accordance with this invention, the process can be substantially improved by the use of a fixed bed reaction zone that performs simultaneously heat exchange to heat the reactants in the reaction zone and to substantially reduce losses due to thermal cracking. Similar process characteristics can contribute to beneficial operations of reforming processes using a fixed bed heat exchange reactor for the first reaction zone. Another reaction that may benefit from the process arrangement of this invention is the production of styrene by dehydrogenation.

A combination of catalyst replacement and indirect heat exchange with a heat transfer fluid can also provide a reaction advantage for processes that use this invention. This combination can provide an isokinetic reaction condition within the reaction stacks. As catalyst is incrementally replaced in the reaction stacks, the most deactivated catalyst is removed from the bottom while the most active catalyst enters the top of the reaction stack. This periodic replacement thereby provides a continuous activity gradient down the length of the catalyst bed in each reaction stack. The decrease in activity can be compensated for by an increase in the reaction temperature. In the case of an endothermic reaction where a heating fluid enters the heat transfer channels, the fluid can enter the heat transfer channels in a flow direction that compensates for the loss of activity in the catalyst. By passing the heat exchange fluid from the bottom of the reaction stack to the top of the reaction stack, higher temperatures are maintained in the lower portion where the more deactivated catalyst contacts reactants. Progressing upwardly through the reaction stack, heating of the reactants cools the heating medium thereby resulting in a relatively reduced temperature for the reactants in the upper portion of the reaction stack which contains the most active catalyst. Tailoring of catalyst replacement, heating medium temperature and heat exchange across the reactant and heat exchange channels can be arranged to provide an isokinetic operation across the reaction zone. This isokinetic operation can result in a more uniform product effluent and the most efficient utilization of the reaction volume in each reaction stack. Isokinetic conditions can be maintained with exothermic reactions as well as with endothermic reactions. In exothermic reactions, the cooling medium should enter the top of the heat exchange channels to maintain a co-current flow with the catalyst so that the maximum cooling is provided at the region of the most active catalyst.

Accordingly, in a broad embodiment, this invention is a process for catalytically converting a feed comprising at least one reactant in an endothermic or exothermic reaction to a reacted stream comprising conversion products by passing the feed serially through at least two reaction zones. The process passes the feed serially through a least one heat exchange reaction zone and at least one moving bed reaction zone in any order. The feed or an effluent from a moving bed reaction zone contacts catalyst at conversion conditions in the heat exchange reaction zone to effect conversion of reactants while simultaneously performing an indirect heat exchange between a heat exchange fluid and the catalyst and reactants to produce a heat exchange reaction zone effluent. The feed or the heat exchange reaction zone effluent contacts a second catalyst comprising catalyst particles at conversion conditions in the moving bed reaction zone to produce a moving bed reaction zone effluent. The process at least periodically withdraws catalyst from the bottom of the moving bed reaction zone and adds catalyst to the top of the moving bed reaction zone while the feed or the heat exchange reaction zone effluent passes through the moving bed reaction zone. The process withdraws a product stream comprising conversion products that have passed through the heat exchange reaction zone and the moving bed reaction zones.

In a more limited embodiment, this invention is a process for catalytically converting a feed comprising hydrocarbons in an endothermic or an exothermic process by passing the feed through at least two reaction zones. The process passes the feed to a first reaction zone and contacts the feed with a catalyst at hydrocarbon conversion conditions to effect hydrocarbon conversion to produce a first reaction zone effluent in the first reaction zone while simultaneously performing an indirect heat exchange in the first reaction zone between a heat exchange fluid and the catalyst and reactants. The first reaction zone effluent passes to a second reaction zone and contacts the second reaction zone effluent with a second catalyst comprising catalyst particles to effect a further conversion of hydrocarbons in the first reaction zone effluent. The process at least periodically withdraws catalyst from the bottom of the second reaction zone and adds catalyst to the top of the second reaction zone while the first reaction zone effluent passes through the second reaction zone. The process withdraws a product stream from the process comprising converted hydrocarbons that have passed through the first and second reaction zones.

In an apparatus embodiment, the invention is a reactor arrangement for contacting reactants with catalyst and indirectly heat exchanging the reactants with a heat transfer fluid and replacing catalyst particles on stream. The arrangement includes a first reactor vessel defining a feed inlet for the addition of a reactant thereto, defining an intermediate outlet for the withdrawal of an intermediate stream therefrom, containing a heat exchange surface that defines a plurality of reaction channels on one side of the heat exchange surface for retaining a catalyst and defines a plurality of heat exchange channels on an opposite side of the heat exchange surface for circulation of heat exchange fluid therein. A second reactor vessel defines an intermediate inlet for adding at least a portion of the intermediate stream thereto, defines a reacted outlet for withdrawing a reacted stream therefrom, contains a perforated surface for retaining catalyst particles in a contacting bed, defines a particle addition inlet for adding catalyst particles to the contacting bed and defines a particle withdrawal outlet for removing catalyst particles from the contacting bed. The apparatus also includes a conduit for communicating the intermediate outlet with the intermediate inlet.

Additional embodiments, arrangements and details of this invention are disclosed in the following detailed description of the invention.

DETAILED DESCRIPTION OF THE INVENTION

Figure 1:
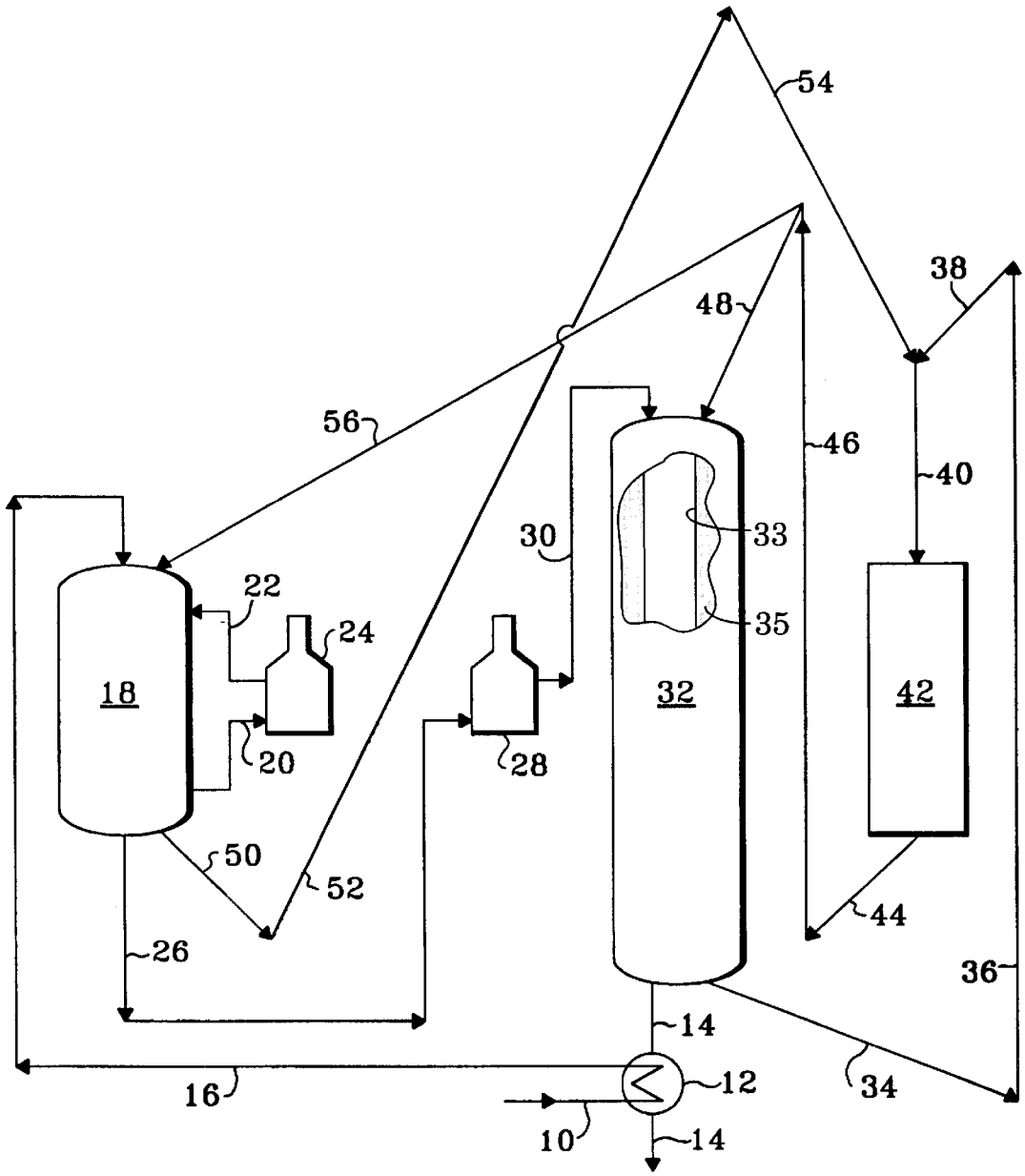
FIG. 1 is a process flow diagram showing the major process equipment of this invention.

The overall process is more fully appreciated from FIG. 1. In brief description, the drawing shows the invention applied to an endothennic process wherein an exchanger 12 heats an entering reactor stream 10 against an effluent of reacted components that leave the process through a line 14. Line 16 carries the heated reactants into contact with a catalyst contained in a reactor vessel 18. Circulation of a heat transfer fluid through line 20, heater 24 and back to reactor vessel 18 through a line 22 heats the catalyst and reactants while the reaction takes place. A line 26 withdraws a heat exchange reaction zone effluent that undergoes additional heating in a heater 28 before entering a reaction vessel 32 via a line 30. Reaction vessel 32 contains particulate catalyst that contacts the reactants for additional reaction and produces a moving bed reaction zone effluent taken by line 14. In the reaction vessel 32, a perforated surface 33 retains catalyst in a contacting bed 35. Reaction vessel 32 may house one or more reaction zones through which catalyst moves by the withdrawal of catalyst from the bottom of the reaction zones through a line 34. A line 36 lifts the catalyst from line 34 for transfer into a catalyst regenerator 42 via lines 33 and 40. After regeneration, catalyst particles pass out of the bottom of regenerator 42 via a line 44. A lift line 46 raises the catalyst particles to an elevation for transfer of regenerated catalyst particles back to reaction vessel 32 via a line 48. Optionally, reactor vessel 18 may also be operated with a moving bed by the withdrawal of catalyst particles from its bottom through a line 50, lifting of the particles in a line 52 and dropping of the particles back into the regeneration zone via lines 54 and 40. Particles lifted via line 46 may be transferred back to the top of reactor vessel 18 via a line 56. Preferably, the optional transfer of catalyst through reactor vessel 18 occurs without interrupting the flow of reactants through reactor vessel 18.

The process may be useful in a wide variety of catalytic reactions that use heterogeneous catalysts. Suitable reaction zone arrangements will employ a moving bed of catalyst as opposed to a fluidized bed of catalyst. Suitable reaction zones will also be of the type that benefit from heat exchange during the reaction.

This invention is most beneficially applied to catalytic conversion processes having high heats of reaction. Typical reactions of this type are hydrocarbon conversion reactions that include the aromatization of hydrocarbons, the reforming of hydrocarbons, the dehydrogenation of hydrocarbons and the alkylation of hydrocarbons. Specific hydrocarbon conversion processes to which this invention are suited include catalytic dehydrogenation of paraffins, reforming of naphtha feed streams, aromatization of light hydrocarbons and the alkylation of aromatic hydrocarbons.

The reaction zones for the process of this invention may indirectly contact the reactants with the heat exchange fluid in any relative direction. Thus, the flow channels and inlets and outlets of the reaction zones may be designed for co-current flow, counter-current flow, or cross-flow of the reactant and heat exchange fluid. Combination of co-current, counter-current, or two bi-directional cross-flow may be used in the same reaction zone. Preferred process arrangements for practicing this invention will pass reactants in cross-flow to the heat exchange fluid. Cross-flow of reactants is generally preferred to minimize the pressure drop associated with the flow of reactants through the reactor. For this reason, a cross-flow arrangement can be used to provide the reactants with a shorter flow path across the reaction zone.

The shorter flow path reduces overall pressure drop of the reactants as they pass through catalyst particles retained in the reactor. Lower pressure drops can have a two-fold advantage in the processing of many reactant streams. Increased flow resistance i.e., pressure drop, can raise the overall operating pressure of a process. In many cases, product yield or selectivity is favored by lower operating pressure so that minimizing pressure drop will also provide a greater yield of desired products. In addition, higher pressure drop raises the overall utility and cost of operating a process.

This invention is particularly suited for the use of a heat exchange reactor having relatively narrow heat exchange and reaction channels defined by a stack of thin plates. It is also not necessary to the practice of this invention that each reaction channel be alternated with a heat exchange channel. Possible configurations of the reaction section may place two or more heat exchange channels between each reactant channel to reduce the pressure drop on the heat exchange medium side. When used for this purpose, a plate separating adjacent heat exchange channels may contain perforations.

Figure 2:
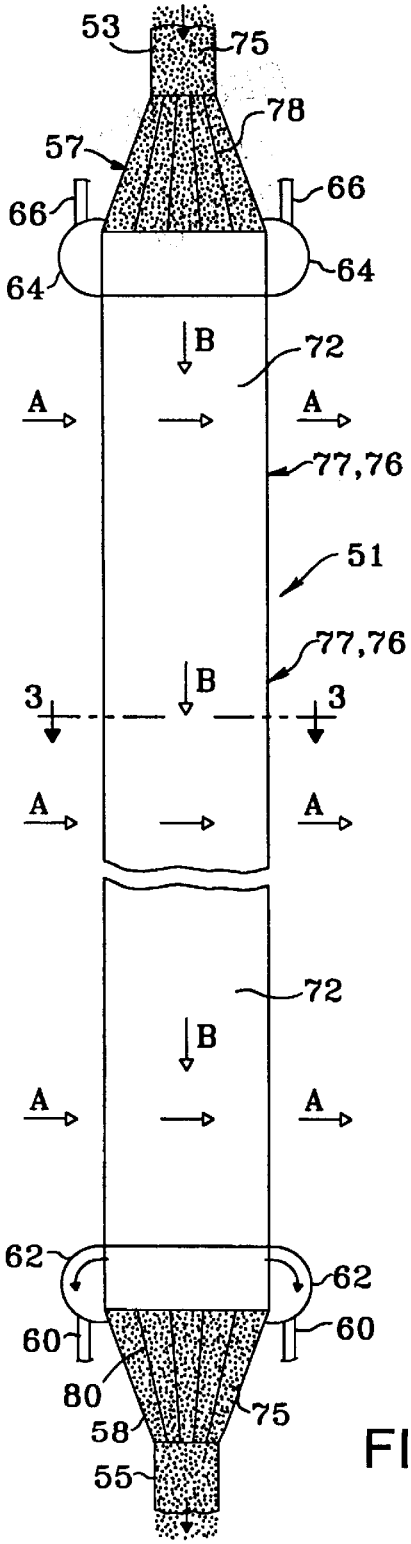
FIG. 2 is a schematic illustration of a heat exchange reactor of this invention.
Figure 3:
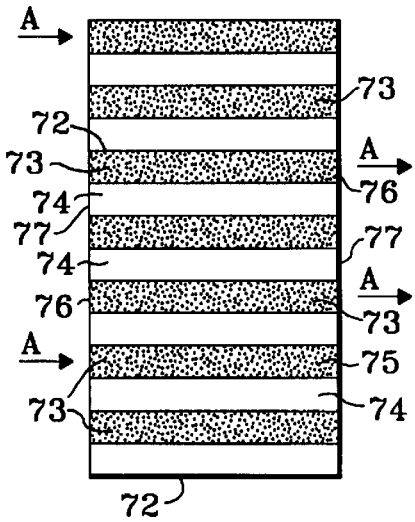
FIG. 3 is a section taken at line 3—3 of FIG. 2.

The arrangement and operation of one reactor arrangement contemplated in the practice of this invention is shown schematically in FIGS. 2 and 3. A reaction arrangement comprises reaction stack 51 of parallel plates 72 as shown in FIG. 3. Suitable plates for this invention will comprise any plates that allow a high heat transfer rate. Although suitable plate thickness may vary, thin plates are preferred and usually have a thickness of from 1 to 2 mm. The plates are typically composed of ferrous or non-ferrous alloys such as stainless steel. Each plate 72 may be smooth but preferably has corrugations that are inclined to the flow of reactants and heat exchange fluid. The plates may be formed into curves or other configurations, but flat plates are generally preferred for stacking purposes. The corrugated plates may be stacked directly next to each other with the space between corrugations defining alternate reactant flow channels 73 and heat exchange channels 74. Where plates 72 contain inclined corrugations, the plates may be stacked next to each other to define the heat exchange and reactant flow channels as the area between corrugations. Preferably, the corrugation pattern will be reversed between adjacent plates so that a herring bone pattern on the faces of opposing corrugated plates will extend in opposite directions and the opposing plate faces may be placed in contact with each other to form the flow channels and provide structural support to the plate sections.

Any catalyst can at least partially fill the reactant flow channels 73. Suitable catalysts may be coated to the inside of the plates. Preferably, catalyst particles 75 fill the reactant flow channels 73 and the reactant stream contacts a particulate catalyst in each of the reaction stacks. The particulate catalyst will normally be present as discrete particles usually in a size range of from 2 to 15 mm in diameter. The particles may have any shape, but they will typically comprise spheres or cylinders. Preferably, both the heat exchange reactor and the moving bed reactor will use the same catalyst.

The sides 76 of reactant flow channels 73 are closed to catalyst flow by a permeable closure that still permits the flow of reactants in the direction indicated by arrows "A". The sides 77 of heat exchange channels 74 have a fluid-impermeable closure that holds the heat exchange fluid over the length of heat exchange channels 74. The tops of the heat exchange channels are closed to prevent catalyst entry therein. As shown in the reaction stack of FIG. 3, the heat exchange fluid flows downwardly as indicated by arrows "B" such that the reaction stack defines a specific circulation system for the flows represented by "A" and "B" wherein the reactant stream of "A" and the heat exchange fluid of "B" flow in cross-wise directions and through alternate channels formed by adjacent plates 72.

Each stack of reaction plates includes in its upper part an inlet for receiving the heat exchange fluid into the circulation system represented by "B". The inlet may be a single opening. FIGS. 2 and 3 show the manifolds 64 and 62 for distributing and collecting heat exchange fluid from the top and the bottom, respectively, of reaction stack 51. Supply pipes 66 supply the heat exchange fluid to a distribution manifold 64. The heat exchange fluid flows vertically down the heat exchange channels in each reaction stack 51. Collection pipes 60 withdraw heat exchange fluid from a collector manifold 62 at the bottom of each reaction stack 51. Manifolds 64 and 62 communicate with the heat exchange channels 74 through openings in the sides 77 that are located at the top and bottom on opposite sides of the reaction stack. The manifolds provide a distribution area on the sides of the reaction stack. Fluid-tight seals block the sides 76 of the reactant channels in the distribution and collection areas covered by manifolds 64 and 62 to prevent the entry of the heat exchange fluid or loss of reactants.

The reaction stack 51 may optionally include means for moving the catalyst. Catalyst may flow from catalyst transfer pipes 53 into a diffuser 57 that distributes catalyst across the top of the reaction channels in each reaction stack. A catalyst collector 58 at the bottom of reaction stack 51 withdraws catalyst through catalyst withdrawal nozzle 55. Diffuser 57 may contain internal baffles or corrugations 78 for distributing catalyst evenly across the top of the reactant channels. Similarly, collector 58 at the bottom of reactant flow channels 73 collects the catalyst particles 75 and may contain baffles or corrugations 80. The baffles or corrugations in the diffuser and collector promote a uniform replacement of catalyst across the entire horizontal length of each reactant flow channel 73. Systems for removing catalyst from stacks of plates are well known to those skilled in the art.

The process may be operated in a variety of ways. The essential element for the unloading or loading of catalyst is that the catalyst can be moved easily through the reaction zones or individual reaction vessels that do not have a heat exchanging function.

Typically, the moving bed zones and, when adapted for catalyst movement, the heat exchange reaction zones will operate with only periodic catalyst replacement. During most of the operation, the catalyst will remain in the reaction zone that it entered and the sequencing of transitory catalyst replacement will occur on a regular cycle of catalyst replacement. Catalyst may be removed in any amount but preferably a volume of catalyst equal to about 25% of the total volume in a reactor is removed by each cycle. As the catalyst is withdrawn from the bottom of the reactor, replacement catalyst flows into the reactor to replace an amount of catalyst equal to that withdrawn.

Although this invention can use any combination of a heat exchange reactor and a moving bed reactor, the preferred combination is a first heat exchange reactor that operates isothermally or with a rising temperature profile when employed in an endothermic process with one or more downstream reaction zones that operate adiabatically and move catalyst through the reaction zone to maintain catalyst activity. The simplified design of providing only one heat exchange reactor reduces overall capital costs whether the single heat exchange reactor is operated with or without catalyst movement therethrough.

In a process for the dehydrogenation of light hydrocarbons, the heat exchange reactor will normally be operated to provide 60 to 80% of the total conversion for the reactant stream on its single pass through the series of reactors. The adiabatic reactor train will provide the remaining amount of conversion. In such an operation, the heat exchange reactor can operate for several weeks at a high conversion condition. Preferably, the moving bed reactor will be provided with an on-stream catalyst regeneration system in which the heat exchange reactor catalyst can be periodically regenerated as well. A pair of heat exchange reactors may be provided to operate the heat exchange reactor section in a swing bed mode and allow periodic replacement of the catalyst located therein.

The invention can also decouple other process conditions between the heat exchange reactor and the moving bed reactor. Since the heat exchange reactor will normally operate at lower temperatures and even though it will be providing, in most cases, a majority of the total conversion through the series of reactors, it will still operate with good catalyst stability. In particular for dehydrogenation processes, this operation will allow a lower hydrogen-to-hydrocarbon ratio in the heat exchange reactor versus the moving bed reactors. The lower hydrogen-to-hydrocarbon ratio improves equilibrium and can lead to a further benefit of lowering reaction temperatures.

A variety of additional flow stream variations may be advantageously incorporated into the combination of the heat exchange reactor and the moving bed reactor. The moving bed reactor may operate at a sufficient temperature for the effluent stream from the moving bed reactor to provide the required preheat for the reactants entering the heat exchange reactor, thereby eliminating the need for a charge heater. Sufficient heat is easily provided since it is only necessary to provide enough heat to get the reactant stream entering the heat exchange reactor into a vaporized state. It is also possible to use a single heater for the heating in both the heat exchange reactor and the moving bed reactor by using the heat transfer fluid from the heat exchange reactor to indirectly provide intermediate heat exchange for the adiabatic reactor sections of the moving bed reactor.

Suitable heat exchange fluids for the heat exchange reactor may comprise any fluid well known to those skilled in the art. Heat exchange fluids may be selected on the basis of their availability and compatibility with the overall process. In such cases, the exchange fluids will normally comprise a fluid of similar composition to that used in the reactant channels. Heat exchange fluids may also be selected on the basis of their heat capacity and thermal conductivity properties. High heat capacity fluids are well known to those skilled in the art and include such materials as molten salts and metals. Methods for circulating molten salts and liquid metals through reaction zones are well known and have been long used in industrial applications such as the nuclear industry. A molten salt heat exchange fluid may comprise liquid sodium.

One process in which this invention can be beneficially utilized is catalytic reforming. Catalytic reforming is a well established hydrocarbon conversion process employed in the petroleum refining industry for improving the octane quality of hydrocarbon feedstocks, the primary product of reforming being motor gasoline. The art of catalytic reforming is well known and does not require extensive description herein. Briefly, in catalytic reforming, a feedstock is admixed with a recycle stream comprising hydrogen and contacted with catalyst in a reaction zone. The usual feedstock for catalytic reforming is a petroleum fraction known as naphtha and having an initial boiling point of about 180° F. (80° C.) and an end boiling point of about 400° F. (205° C.). The catalytic reforming process is particularly applicable to the treatment of straight run gasoline comprised of relatively large concentrations of naphthenic and substantially straight chain paraffinic hydrocarbons, which are subject to aromatization through dehydrogenation and/or cyclization reactions. Reforming may be defined as the total effect produced by dehydrogenation of cyclohexanes and dehydroisomerization of alkylcyclopentanes to yield aromatics, dehydrogenation of paraffins to yield olefins, dehydrocyclization of paraffins and olefins to yield aromatics, isomerization of n-paraffins, isomerization of alkylcycloparaffins to yield cyclohexanes, isomerization of substituted aromatics and hydrocracking of paraffins. Further information on reforming processes may be found in, for example, U.S. Pat. No 4,119,526 B1, U.S. Pat. No. 4,409,095 B1 and U.S. Pat. No. 4,440,626 B1, the contents of which are herein incorporated by reference.

A catalytic reforming reaction is normally effected in the presence of catalyst particles comprised of one or more Group VIII noble metals (e.g., platinum, iridium, rhodium and palladium) and a halogen combined with a porous carrier such as a refractory inorganic oxide. The halogen is normally chlorine. Alumina is a commonly used carrier. The preferred alumina materials are known as the gamma-, eta- and the theta-alumina with gamma- and eta-alumina giving the best results. An important property related to the performance of the catalyst is the surface area of the carrier. Preferably, the carrier will have a surface area of from 100 to about 500 $m^2/g$. The particles are usually spheroidal and have a diameter of from about 1/16 to about 1/8-inch (1.5 to 3.1 mm), though they may be as large as 1/4-inch (6.35 mm). A preferred catalyst particle diameter is 1/16-inch (3.1 mm). During the course of a reforming reaction, catalyst particles become deactivated as a result of mechanisms such as the deposition of coke on the particles; that is, after a period of time in use, the ability of catalyst particles to promote reforming reactions decreases to the point that the catalyst is no longer useful. The catalyst must be reconditioned, or regenerated, before it can be reused in a reforming process.

In preferred form, reforming operations employ a moving bed reaction zone and regeneration zone. The present invention is applicable to such moving bed zones. In a moving bed operation, fresh catalyst particles are fed to a reaction zone by gravity. Catalyst is withdrawn from the bottom of the reaction zone and transported to a regeneration zone where a multi-step regeneration process is used to recondition the catalyst to restore its full reaction-promoting ability. Catalyst flows by gravity through the various regeneration steps and then is withdrawn from the regeneration zone and furnished to the reaction zone. Catalytic reforming processes typically effect the repeated transfer of relatively small amounts of catalyst at closely spaced points in time. Therefore, while the catalyst movement is often referred to as continuous, it is actually semi-continuous. When using the process of this invention in a reforming operation, the first reaction zone will preferably be a heat exchange reactor that operates without catalyst movement.

Catalytic dehydrogenation is another example of an endothermic process that advantageously uses the process and apparatus of this invention. Briefly, in catalytic dehydrogenation, a feedstock is admixed with a recycle stream comprising hydrogen and contacted with catalyst in a reaction zone. Feedstocks for catalytic dehydrogenation are typically petroleum fractions comprising paraffins having from about 3 to about 18 carbon atoms. Particular feedstocks will usually contain light or heavy paraffins. For example, a usual feedstock for producing heavy dehydrogenation products will comprise paraffins having 10 or more carbon atoms. The catalytic dehydrogenation process is particularly applicable to the treatment of hydrocarbon feedstocks containing substantially paraffinic hydrocarbons which are subject to dehydrogenation reactions to thereby form olefinic hydrocarbon compounds.

A catalytic dehydrogenation reaction is normally effected in the presence of catalyst particles comprised of one or more Group VIII noble metals (e.g., platinum, iridium, rhodium and palladium) combined with a porous carrier such as a refractory inorganic oxide. Alumina is again a commonly used carrier and the preferred alumina materials are again the same as those described for catalytic reforming. Generally, the catalyst particles have a chloride concentration of between 0.5 and 3 wt-%. During the course of a dehydrogenation reaction, catalyst particles also become deactivated as a result of coke deposition and require regeneration similar to that described in conjunction with the reforming process; therefore, the dehydrogenation process will again employ the moving bed reaction zone. It has been found, however, that in a typical 4-bed dehydrogenation operation, the rate of coking approximately doubles through each subsequent reaction stage. Therefore, the first reaction stage experiences far less coking than the subsequent reaction stages and is well suited for application of this invention.

Dehydrogenation conditions typically include a temperature of from about 752° to about 1652° F. (400° to about 900° C.), a pressure of from about 0.2 to 147 psia (0.01 to 10 atm) and a liquid hourly space velocity (LHSV) of from about 0.1 to 100 $hr^{-1}$. Generally, for normal paraffins, the lower the molecular weight, the higher the temperature required for comparable conversions. The pressure in the dehydrogenation zone is maintained as low as practicable, consistent with equipment limitations, to maximize the chemical equilibrium advantages. The preferred dehydrogenation conditions of the process of this invention include a temperature of from about 752° to 1292° F. (400° to 700° C.), a pressure from about 1.5 to 73 psia (0.1 to 5 atm) and an LHSV of from about 0.1 to 100 $hr^{-1}$.

The effluent stream from the dehydrogenation zone generally will contain unconverted dehydrogenatable hydrocarbons, hydrogen and the products of dehydrogenation reactions. This effluent stream is typically cooled and passed to a hydrogen separation zone to separate a hydrogen-rich vapor phase from a hydrocarbon-rich liquid phase. Generally, the hydrocarbon-rich liquid phase is further separated by means of a suitable selective adsorbent, a selective solvent, a selective reaction or reactions, or by means of a suitable fractionation scheme. Unconverted dehydrogenatable hydrocarbons are recovered and may be recycled to the dehydrogenation zone. Products of the dehydrogenation reactions are recovered as final products or as intermediate products in the preparation of other compounds.

The dehydrogenatable hydrocarbons may be admixed with a diluent gas before, while, or after being passed to the dehydrogenation zone. The diluent material may be hydrogen, steam, methane, carbon dioxide, nitrogen, argon and the like, or a mixture thereof. Hydrogen is the preferred diluent. Ordinarily, when a diluent gas is utilized as the diluent, it is utilized in amounts sufficient to ensure a diluent gas-to-hydrocarbon mole ratio of about 0.1 to about 20, with the best results being obtained when the mole ratio is about 0.4 to 10. The diluent hydrogen stream passed to the dehydrogenation zone will typically be recycled hydrogen separated from the effluent from the dehydrogenation zone in the hydrogen separation zone.

Water, or a material which decomposes at dehydrogenation conditions to form water, such as an alcohol, aldehyde, ether or ketone, may be added to the dehydrogenation zone. The water or water precursor may be added either continuously or intermittently in an amount to provide, calculated on the basis of equivalent water, from about 1 to about 20,000 wt-ppm of the hydrocarbon feed stream. The addition of from about 1 to about 10,000 wt-ppm of water gives best results when dehydrogenating paraffins having from 6 to 30 or more carbon atoms. Additional information related to the operation of dehydrogenation catalysts, operating conditions and process arrangements can be found in U.S. Pat. No. 4,677,237 B1, U.S. Pat. No. 4,880,764 B1 and U.S. Pat. No. 5,087,792 B1, the contents of which are hereby incorporated by reference.

EXAMPLES

Example I

The effect of using the process and reactor arrangement of this invention was investigated in a hydrocarbon conversion process for the dehydrogenation of paraffins. This simulation predicted the results of first contacting a dehydrogenation feed in a heat exchange reactor which then passes through two adiabatic reactors through which the catalyst is changed out by semi-continuous replacement in approximately 2% increments. The catalyst is a typical dehydrogenation catalyst comprising a platinum on an alumina support. The process operated at a molar hydrogen-to-hydrocarbon ratio of 0.3 based on combined feed. The hydrocarbon feed stream at a flow rate of about 28,600 BPSD (barrels per stream day) entered the reaction zone and had a mol-% propane purity of about 98.1%. The combined feed stream entered the heat exchange reactor at a temperature of about 1000° F. (538° C.) and exited at an average outlet temperature of about 1100° F. (593° C.). The feed stream was counter-currently contacted with 7.5 million lbs/hr of a heating medium having a density of approximately 49.9 $lbs/ft^3$ and a heat capacity of 0.398 BTU/lbs/° F. The heating medium entered the process at a temperature of about 1144° F. (618° C.) and exited at an average outlet temperature of about 1119° F. (604° C.). The heat exchange reactor had about 46% of the total catalyst loading and accounted for approximately 58% of the total conversion through the reaction zones. The effluent from the heat exchange reaction zone continued through two adiabatic reaction zones that contained 26% and 28% of the catalyst loading, respectively, and accounted for about 22% and 20% of the total conversion. The adiabatic reactors operated with an inlet temperature of about 1200° F. (649° C.). The total weight percent conversion of the feed was about 36.4 wt-% of the propane at a selectivity of about 91.5 wt-% propylene. The process produced light ends totaling approximately 3.9 wt-% of the converted propane with about 1.4 wt-% being converted to methane, about 0.12 wt-% being converted to ethylene and about 2.4 wt-% being converted to ethane.

Example II

A comparison of a more conventional dehydrogenation process using a conventional adiabatic reactor arrangement with periodic on-stream catalyst replacement was investigated. The simulator predicted the results of using four adiabatic reactors having respective catalyst loadings of 22%, 24%, 26% and 28% of the same catalyst used in Example I. The catalyst was again periodically changed out completely over a 4-day period. The process operated at a molar hydrogen-to-hydrocarbon ratio of 0.6 based on the combined feed and treated a hydrocarbon feed stream at a flow rate of about 30,700 BPSD. The feed stream entered the four reactors at temperatures of 1175°, 1195°, 1210° and 1210° F. (635°, 646°, 654° and 654° C.), respectively. The feed to the reaction zones again had a propane purity of about 98.2%. The four reactors accounted, respectively, for approximately 38.2%, 23.3%, 19.7% and 18.8% of the total conversion. Propane conversion through the four reaction zones was about 35.8 wt-% with a propane selectivity of 86.4 wt-%. The total light ends produced by the conventional dehydrogenation arrangement was about 7.4 wt-% of the converted propane with about 3.3 wt-% being converted to methane, about 0.3 wt-% being converted to ethylene and about 5.9 wt-% being converted to ethane.

Accordingly, it is seen from this example that a comparison of the two process simulations shows that the use of a heat exchange reactor as a first reaction zone in combination with two adiabatic reaction zones converts the same product stream in a manner that increases the total conversion by about 0.5% while increasing the selectivity to the desired propylene product by over 5 wt-%. The total production of unwanted light materials is also reduced by about one half through the heat exchange reaction zone in combination with the adiabatic reaction zones of this invention.

What is claimed is:

1. A reactor arrangement for contacting reactants and indirectly heat exchanging the reactants with a heat transfer fluid and replacing catalyst particles on stream, the arrangement comprising:

a first heat exchange reactor vessel defining a feed inlet for the addition of a reactant thereto, defining an intermediate outlet for the withdrawal of an intermediate stream therefrom, containing a heat exchange surface that defines a plurality of reaction channels on one side of the heat exchange surface for containing a catalyst and that defines a plurality of heat exchange channels on an opposite side of the heat exchange surface for circulation of heat exchange fluid therein;

a second adiabatic reactor vessel defining an intermediate inlet for adding at least a portion of the intermediate stream thereto, defining a reacted outlet for withdrawing a reacted stream therefrom, containing a perforated surface for retaining catalyst particles in a contacting bed, providing a particle addition inlet for adding catalyst particles to the contacting bed and providing a particle withdrawal outlet for removing catalyst particles from the contacting bed; and a conduit for communicating the intermediate outlet with the intermediate inlet.

2. The reactor arrangement of claim 1 wherein the heat exchange surface comprises a plurality of parallel plates that define heat transfer channels between each reaction channel.

3. The reactor arrangement of claim 1 further comprising means for passing a heat exchange fluid through the heat exchange channels.

4. The reactor arrangement of claim 1 wherein a plurality of corrugated plates provide the heat exchange surfaces that define heat exchange channels and the reactant channels.

5. The reactor arrangement of claim 1 wherein the first reactor vessel provides a channel particle inlet for adding catalyst particles to the reaction channels and provides a channel particle outlet for removing catalyst particles from the reaction channels.

6. The reactor arrangement of claim 1 further comprising a catalyst regenerator for receiving spent catalyst from the second reactor vessel and optionally the first reactor vessel and returning regenerated catalyst particles to the second reactor vessel and optionally the first reactor vessel.

* * * * *